US005477266A

United States Patent [19]

Shirakawa

[11] Patent Number: 5,477,266

[45] Date of Patent: Dec. 19, 1995

[54] THERMAL HEAD, MANUFACTURING METHOD, AND THERMAL PRINTER USING THE THERMAL HEAD

[75] Inventor: Takashi Shirakawa, Iwate, Japan

[73] Assignee: Alps Electric Co., Ltd., Tokyo, Japan

[21] Appl. No.: 275,698

[22] Filed: Jul. 14, 1994

[30] Foreign Application Priority Data

Jul. 15, 1993 [JP] Japan ..... 5-175439

[51] Int. Cl.[6] ..... B41J 2/335

[52] U.S. Cl. ..... 347/208; 347/201

[58] Field of Search ..... 346/76 PH; 347/208, 347/201

[56] References Cited

U.S. PATENT DOCUMENTS

| | | | |
|---|---|---|---|
| 4,768,038 | 8/1988 | Shibata | 346/76 PH |
| 4,795,887 | 1/1989 | Myokan | 346/76 PH |
| 4,907,015 | 3/1990 | Kaneko et al. | 346/76 PH |

FOREIGN PATENT DOCUMENTS 0061265 3/1989 Japan .

*Primary Examiner*—Huan H. Tran

*Attorney, Agent, or Firm*—Guy W. Shoup; Patrick T. Bever

[57] ABSTRACT

The present invention relates to a thermal head and the manufacturing method. In the thermal head, even when a multilayer wiring constitution is adopted, a trouble caused by bad connection or bad insulation in respective layers can be certainly prevented, and even if a real edge constitution is adopted, manufacturing is easy and reliability can be maintained high.

A heat insulating layer is formed in a position corresponding to that of a heating portion on a substrate; a conductive layer composed of a resistor material is formed on the upper surfaces of the substrate and the heat insulating layer; an insulating layer which is obtained in oxidizing the surface of the conductive layer with a thermal oxidation method is formed on the conductive layer except the area which corresponds to the positions of a common electrode and the terminal portion of the common electrode; predetermined heating resistors are formed so that their both end parts can be positioned on the upper side of the insulating layer and the conductive layer respectively; individual electrodes are formed in the edge portion of the upper surface of the heating resistors on the side of the insulating layer; and a common electrode is formed in the edge portion on the side of the conductive layer.

5 Claims, 4 Drawing Sheets

THERMAL HEAD, MANUFACTURING METHOD, AND THERMAL PRINTER USING THE THERMAL HEAD

2. BACKGROUND OF THE INVENTION (1) Field of the Invention

The present invention relates to a thermal head and a thermal printer using the thermal head, in particular, it relates to a thermal head which can be improved to a real edge thermal head and which can improve the printing quality when the thermal head is used for a printer of a thermal transcription system, the manufacturing method of the thermal head, and a thermal printer using the thermal head.

(2) Description of the Prior Art

In a thermal head to be mounted on a thermal printer, a plurality of heating elements are disposed in a straight line on a substrate and one of the heating elements is selectively energized to be heated one after another based on a desired printing information; thereby, in a thermosensible printer, a thermosensible recording paper is colored and in a thermal transcription printer, ink on an ink ribbon is partially melted and it is transcribed on a plain paper for printing.

FIG. 7 shows a general thermal head of a conventional type. A heat insulating layer 2 composed of glass, etc. is formed on a substrate 1 which is composed of an insulating material such as alumina and the upper surface of the heat insulating layer 2 is formed to be a part of a circular arc, and a plurality of heating resistors 3 are formed in a straight line on the top 2*a* of the insulating layer 2, and these heating resistors are formed by photolithography or etching after a material for heating resistors composed of $Ta_2N$ or the like is attached on the surface of the heat insulating layer 2 by vapor deposition or sputtering. A common electrode 4*a* to be connected to heating resistors 3 is formed by lamination on a side of the upper surface of the heating resistors 3 and individual electrodes 4*b* for energizing each of the heating resistors independently are formed by lamination on the other side of the heating resistors 3. The above-mentioned common electrode 4*a* and individual electrodes 4*b* are composed of Au or Cu, for example, and after they are attached by vapor deposition, sputtering, etc., they are formed into desired patterns by etching, etc.

A protective layer 5 which is 7 to 10 μm thick for protecting heating resistors 3 and electrodes, 4*a* and 4*b*, is formed over the heating resistors 3, the common electrode 4*a*, individual electrodes 4*b*, an exposed part on the surface of the substrate 1, and the surface of the heat insulating layer 2. The protective layer 5 is formed to cover all the surfaces except the terminal portions of the electrodes, 4*a* and 4*b*.

In the case of such a conventional thermal head, it has been needed to make the resistance of the common electrode 4*a* low by forming the width of the electrode wide, so that, as shown in FIG. 7, the heating portions 3*a* of the heating resistors 3 are disposed in the central part or in the vicinity of the edge portion of the thermal head substrate 1, and the distance from the heating portions 3*a* of the heating resistors 3 to the edge portion of the substrate 1 has been more than several mm.

In recent years, the demand for the real edge constitution of a thermal head, that is, the demand for disposing the heating resistors 3 of a thermal head in a closer position to the edge of a substrate 1 is increasing, and it is urgently needed to sharply curtail the space on the side of the common electrode 4*a* on the substrate 1. The real edge constitution of a thermal head offers merits as shown below: it decreases the loss in the abutting pressure of a head against a platen and improves printing energy efficiency, and in the case of a thermal transcription printer using an ink ribbon, inks of a variety of kinds, from the ink of a wax group to the ink of a resin group, can be used, and the printing quality can be remarkably improved when a rough paper (a paper having a low degree of smoothness on the printing surface) is used.

When the real edge constitution of a thermal head having an edge distance of less than 0.2 mm is contrived, the space for the disposition of a common electrode 4*a* becomes very small, so that the width dimension of the common electrode 4*a* has to be extremely thin; in the result, the resistance of the common electrode 4*a* is so increased as to be regarded as a resistor, and the difference in voltage drops between both end parts and the central part becomes large. In some case, the current capacity of the common electrode 4*a* becomes insufficient and when the heating resistors are energized, a trouble such as a breakdown of the common electrode 4*a* can occur, and it has been very difficult to manufacture a real edge head having high utility.

As other types of electrodes of a thermal head (not shown in a drawing) in which real edge constitution is contrived, there are, for example, turnup electrodes or comb type electrodes in which leads of a common electrode and individual electrodes are led to the same side; in such a case, however, when the resolution is assumed to be 300 dpi (dots per inch), the working precision equivalent to that in a case of 600 dpi is required, and in the similar way, when the resolution is assumed to be 400 dpi, the working precision equivalent to that in a case of 800 dpi is required. In the above case, there are demerits as shown below: manufacturing mandays are increased, manufacturing yield is lowered, reliability of products is lowered, and the manufacturing cost is increased.

Further, there is a thermal head in which a common electrode is formed onto the back surface from the edge portion of a thermal head substrate; however, there are demerits in such a thermal head as shown below: since electrodes are formed after division and polishing of a substrate, a lot of manufacturing mandays are required, manufacturing efficiency is lowered, and the reliability in a real edge constitution within 0.2 mm is extremely low.

In the case of an edge surface head, the edge surface of a substrate is polished to form a heat insulating layer on it and then heating elements are formed on the layer. Therefore, similar to the above case, a lot of mandays are needed, and mass productivity is lowered when a real edge constitution is contrived, which raises the manufacturing cost.

In consideration of these points, there has been a thermal head in which real edge constitution is contrived in adopting a multilayer wiring constitution for a common electrode in the heating portion. In this case, a conductive layer composed of a metallic material is formed on a heat insulating layer, and a layer insulating layer composed of $SiO_2$, etc. is laminated on the conductive layer with a technique such as etching, and then the layer insulating layer is partially removed with a technique of photolithography, and heating resistors are laminated over it for the purpose of connecting the conductive layer and the heating resistors electrically. The layer insulating layer and the conductive layer are formed into a lamination structure and disposed right under the heating resistors which are heated to a high temperature.

In the case of a thermal head having a multilayer wiring constitution as described in the above, when a desired heating resistor is energized through an individual electrode based on a desired printing signal, electricity can be supplied through the conductive layer beside the common electrode which is formed to have an extremely narrow width for the purpose of obtaining a real edge constitution, so that the effective resistance of the common electrode is kept low and the occurrence of partial voltage difference in the heating resistors or the occurrence of insufficiency in the current capacity of the common electrode can be prevented, which makes it possible to perform printing of high quality.

In the case of a conventional thermal head, however, there are problems as described below: a layer insulating layer is formed on a conductive layer and besides the layers are formed right under the heating resistors which are heated to a high temperature, so that the stress between layers becomes large and the reliability in the adhesive force between layers against a heat shock is lowered much; the layer insulating layer is formed with etching, so that there can be produced a difference in level between the surface of the layer insulating layer and the surface of the conductive layer, which may cause bad connection between the heating resistors and the conductive layer; and moreover when the layer insulating layer is formed with a vapor deposition system such as a sputtering method, a pin hole can occur in the layer insulating layer caused by a foreign substance, etc., which may cause an insulation trouble.

When the thickness of the layer insulating layer is increased, a problem can occur in that the stress imbalance between layers grows larger and also the reliability can be lowered with bad connection, etc. caused by the increase in the level difference produced in the etching process.

3. SUMMARY OF THE INVENTION

An object of the present invention is to offer: a thermal head in which the problems mentioned in the above are solved, and even when a multilayer wiring constitution is adopted, the occurrence of a trouble caused by bad connection or bad insulation between layers can be securely prevented, and even when a real edge constitution is adopted, the manufacturing of a thermal head is easy and the reliability can be kept high; a manufacturing method of the thermal head; and a printer using the thermal head.

Another object of the present invention is to offer a thermal head having the constitution as described below: an heat insulating layer is formed in a position corresponding, at least, to a heating portion on a substrate, a conductive layer comprising a resistor material is formed over the upper surface of the substrate and the heat insulating layer, an insulating layer is formed by oxidizing the surface of the conductive layer by thermal oxidation except the area positioned corresponding to the common electrode and the terminal portion of the common electrode, predetermined heating resistors are formed to have their both end parts positioned on the upper side of the insulating layer and the conductive layer respectively, individual electrodes are formed in a portion of the upper surface of the heating resistors on the side of the insulating layer, and a common electrode is formed in a portion of the upper surface of the heating resistors on the side of the conductive layer.

A further object of the present invention is to offer a manufacturing method comprising manufacturing steps as described below: a step for forming a heat insulating layer, at least, in the corresponding area to the heating portion on a substrate, a step for laminating a conductive layer comprising a material for a resistor on the upper surfaces of the substrate and the heat insulating layer, a step for laminating a masking layer on the conductive layer, a step for forming a masking pattern in the area corresponding to the formed positions of the common electrode and the terminal portion of the common electrode of the masking layer, a step for forming an insulating layer by oxidizing the surface of the conductive layer with a thermal oxidation process in an oxidizing atmosphere except the area in which the masking layer is formed by the masking pattern, a step for forming predetermined heating resistors to have their both end parts positioned on the insulating layer and the conductive layer respectively, and a step for forming individual electrodes in a portion of the upper surface of the heating resistors on the side of the insulating layer and forming a common electrode in a portion of the upper surface of the heating resistors on the side of the conductive layer.

Yet another object of the present invention is to offer a thermal printer using a thermal head having the constitution as described in the above.

A desirable constitution of a thermal-head and its manufacturing method according to the present invention is described below: after the conductive layer is formed with a Ta-$SiO_2$ cermet or a silicide resistor material of Ta-Si, etc. to be about 2 to 10 μm thickness the surface of the conductive layer is oxidized with a thermal oxidation process to form an insulating layer of about 1 μm thickness comprising $Ta_2O_5$/$SiO_2$, and the conductive layer can be formed to be a film being controlled its conductivity by Ar+$O_2$ reactive sputtering using Ta-Si silicide. Further, the insulating layer is formed on the surface of the conductive layer to be a unity, and the level of the surface of the insulating layer and that of the conductive layer are approximately in the same level.

While the insulation layer is formed with a thermal oxidation process, the annealing of the substrate, the heat insulating layer, the conductive layer, and the insulating layer is performed simultaneously. Further, the masking layer can be formed with an oxidation-resistant metal such as Al or Au, with an oxidation-resistant conductive ceramic such as ITO or $RuO_2$, or with an oxidation-resistant insulating ceramic such as $SiO_2$ or $Si_3N_4$. In some case, the masking layer is formed with a conductive material, and after a thermal oxidation process, heating resistors are formed without removing the masking layer.

According to the present invention, as described in the above, since a conductive layer having the same function as that of the common electrode is provided almost on the whole surface of the substrate, a current can flow through the conductive layer beside the common electrode, so that a uniform voltage can be applied to each of the individual heating resistors, which makes it possible to correspond properly to the real edge constitution of a thermal head. The insulation between the conductive layer and the heating resistors is performed with an insulating layer composed of $Ta_2O_5$ or $SiO_2$ obtained by a thermal oxidation process, so that the inside of a pin hole is also oxidized and has enough insulating property; moreover, the insulating layer is formed to be a unity with the conductive layer, so that the degree of insulation and the degree of adhesiveness can be extremely improved. It is also possible to make the surface of the insulating layer and the surface of the exposed part of the conductive layer be approximately in the same level, so that heating resistors can be formed on a surface in a state of little level difference, which secures the electrical connection between the heating resistors and the conductive layer, and further thermal oxidation of the conductive layer performs high temperature annealing of the whole substrate simultaneously, which makes it possible to secure the mechanical and thermal reliability of the multilayer wiring substrate.

4. BRIEF DESCRIPTION OF THE DRAWINGS

5. DETAILED DESCRIPTION OF THE PREFERRED EMBODIMENTS

Figure 1:
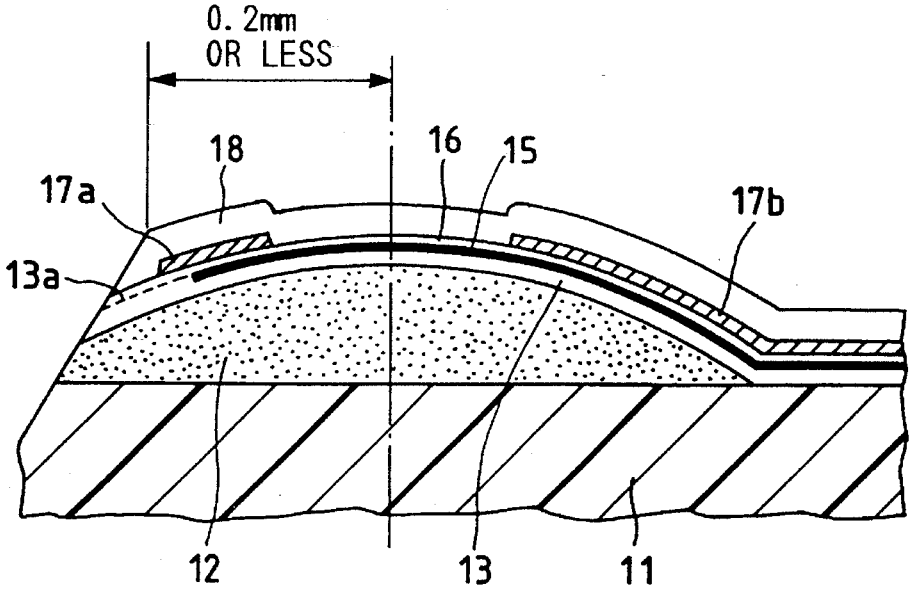
FIG. 1 is a cross sectional view showing an embodiment of a thermal head according to the present invention.
Figure 2:
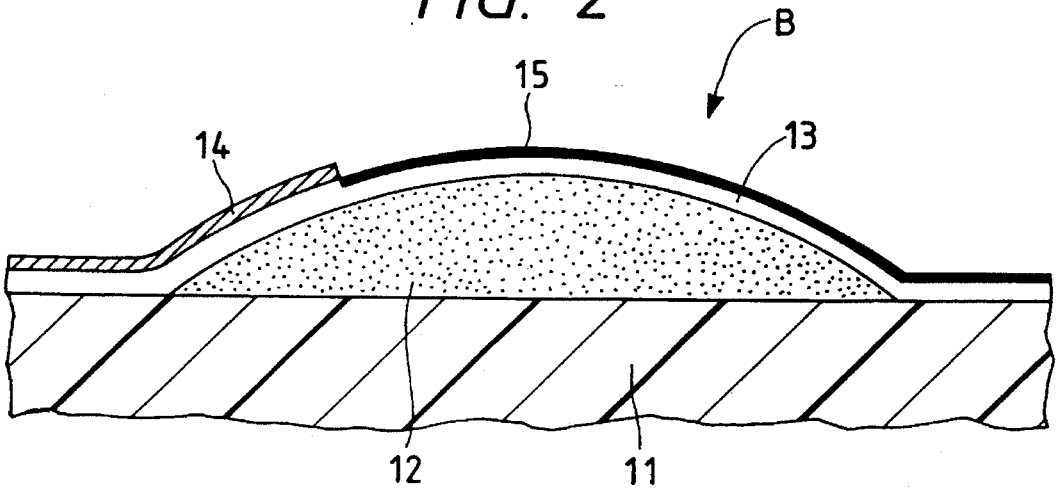
FIG. 2 is a cross sectional view of a flat multilayer wiring substrate which constitutes a thermal head according to the present invention.
Figure 3:
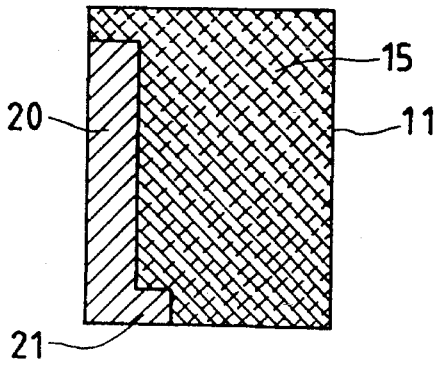
FIG. 3 is a plan view of the upper surface of a flat multilayer wiring substrate which constitutes a thermal head according to the present invention.

FIG. 1 shows an embodiment of a thermal head according to the present invention and FIG. 2 and FIG. 3 show the multilayer wiring substrate B of a thermal head according to the present invention.

FIG. 1 shows an embodiment of a thermal head according to the present invention, and a heat insulating layer 12 composed of glass, etc. is formed in a convex shape forming a part of a circular arc on an insulating substrate 11 such as a ceramic substrate, and a conductive layer 13 is formed on the upper surfaces of the substrate 11 and the heat insulating layer 12. As shown in FIG. 3, an insulating layer 15 is formed on the upper surface of the conductive layer 13 except a disposed portion 20 of a common electrode **17*a* of a thermal head and a connecting portion with an external terminal 21, and in the other part the conductive layer 13 is exposed. The surface of the insulating layer 15 and the surface of the exposed part 13*a* of the conductive layer 13** are almost in the same level.

The material of the heating resistors 16 is attached on the upper surfaces of the conductive layer 13 and the insulating layer 15 by vapor deposition or sputtering, and then a plurality of heating resistors 16 are formed in line by etching with a technique of photolithography having their both end parts positioned on the upper side of the conductive layer 13 and the insulating layer 15 respectively. A common electrode **17*a* to be connected to the individual heating resistors 16 is laminated in the edge portion of the upper surface of the individual heating resistors on the side of the conductive layer 13, and the individual electrodes 17*b* to be used for energizing each of the individual heating resistors 16 independently are laminated in the edge portion of the upper surface of the heating resistors 16 on the side of the insulating layer 15**.

A protective layer 18 which is 7 to 10 μm thick is formed on the surfaces of the heating resistors 16, the common electrode **17*a*, the individual electrodes 17*b*, an exposed part of the substrate 11, and the heat insulating layer 12 for the protection of the heating resistors 16 and electrodes, 17*a* and 17*b*; thus the protective layer 18 covers all over the surfaces except the surfaces of the terminal portions of the electrodes, 17*a* and 17*b***.

Figure 4:
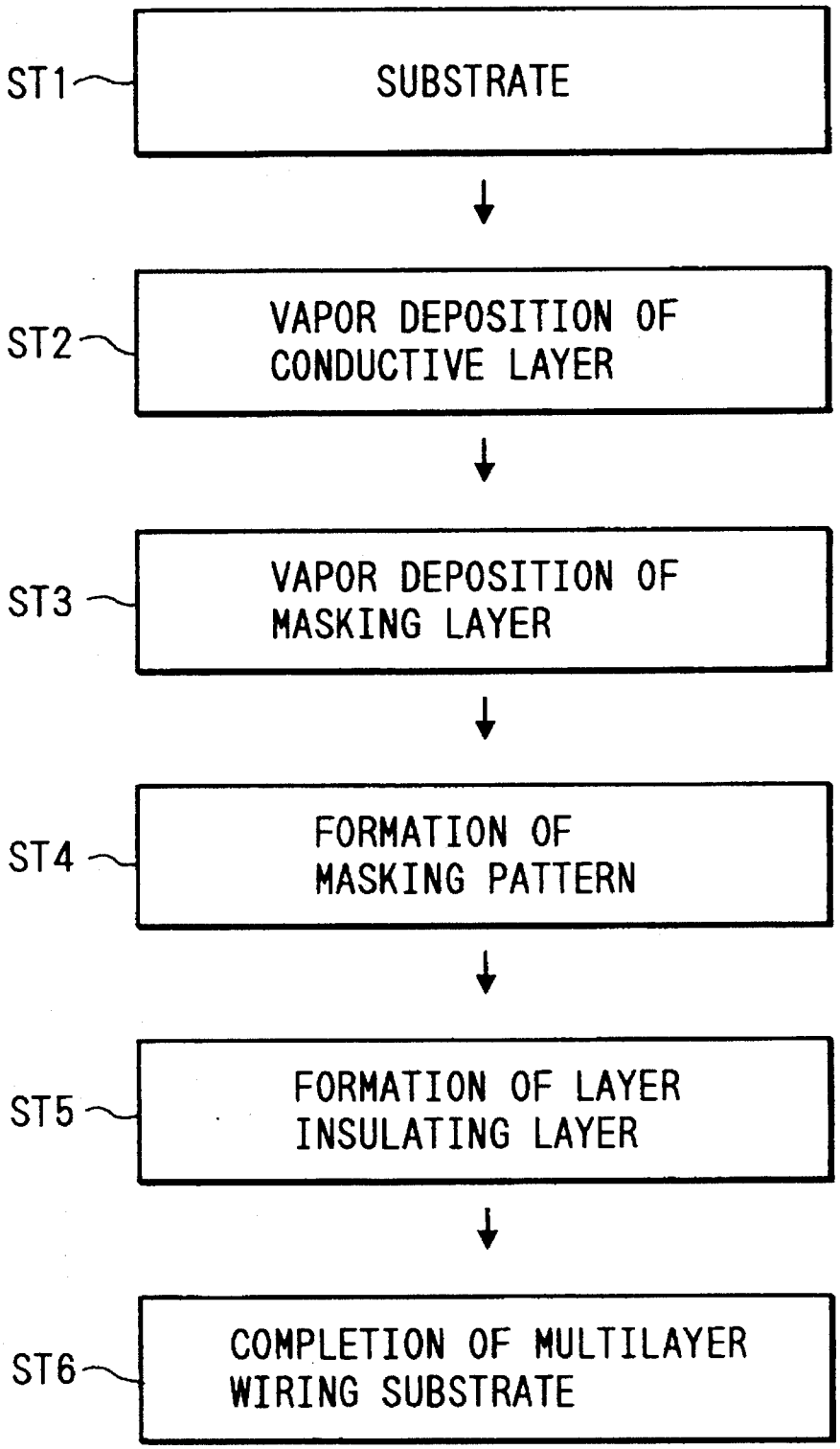
FIG. 4 is a flow chart showing the manufacturing process of a multilayer wiring substrate according to the present invention.

Next, the manufacturing method of a thermal head in the present embodiment will be explained referring to the flow chart showing the manufacturing process of the multilayer wiring substrate B shown in FIG. 4.

At first, as shown in FIG. 2, a heat insulating layer 12 composed of glass, etc., which has an upper surface formed in a convex shape being a part of a circular arc, is formed on the upper surface of a flat substrate 11 composed of alumina, etc. (step ST1).

A conductive layer 13 composed of Ta-$SiO_2$ cermet is formed to be 2 to 10 μm thick on the upper surface of the substrate 11 and the heat insulating layer 12 by vapor deposition, sputtering, etc. (step ST2). The conductive layer 13 can be formed with, for example, such a silicide resistor material as Ta-Si silicide besides Ta-$SiO_2$ cermet. When Ta-Si silicide is applied, in particular, the stress or the conductivity of a film can be controlled with a reactive sputtering method and also the film formation speed is higher than the case where Ta-$SiO_2$ is applied, so that productivity in the manufacture of a film becomes higher than the case where Ta-$SiO_2$ is applied. It is also possible to form the conductive layer 13 with such a resistor material as $Ta_2N$ or Cr-$SiO_2$.

Next, a masking layer 14 of about 0.2 μm thick composed of Al having heat-resistant property and oxidation-resistant property is laminated by a vapor deposition method on the upper surface of the conductive layer 13 in the corresponding areas to a disposed portion of a common electrode **17*a* of a thermal head and that of a connecting portion to an external terminal (not shown in a drawing) (step ST3). The material of the masking layer 14** is not limited to Al, and an oxidation resistant metal such as Au, an oxidation resistant conductive ceramic such as ITO or $RuO_2$, or an oxidation resistant insulating ceramic such as $SiO_2$ or $Si_3N_4$ can be applied.

Then a masking pattern is formed in the disposed portions of the common electrode **17*a* and the connecting portion to an external terminal with a photolithographic technique (step ST4**).

After that, an insulating layer 15 of about 1 μm thick composed of $Ta_2O_5/SiO_2$ is formed by forced oxidation of the surface of the conductive layer 13 at a temperature higher than 600° C. using a heat-treatment furnace of oxygen atmosphere (step ST5). Then the masking layer 14 is removed with etching, etc. and the manufacturing of the multilayer wiring substrate B according to the present invention is completed (step ST6). In this case, if a conductive material is used as a material for the masking layer 14, electric connection to the conductive layer 13 can be secured as it is, so that there is no need to remove the masking layer 14, which makes it possible to reduce manufacturing man-days.

A real edge thermal head, as shown in FIG. 1, can be manufactured with the same manufacturing process as that of a conventional thermal head, in laminating and patterning the heating resistors 16 composed of a resistor material such as $Ta_2N$, Ta-$SiO_2$, Ta-Si, or Cr-$SiO_2$, the electrodes, **17*a* and 17*b*, and a protective layer 18** on the multilayer wiring substrate B.

Next, the operation of the present embodiment will be explained.

In the present embodiment, when a desired heating resistor 16 is energized through one of the individual electrodes **17*b* based on a desired printing signal, since a conductive layer 13 having the same function as that of the common electrode 17*a* is disposed approximately over the whole surface of the substrate 11, the current to energize an electrode can flow through the conductive layer 13 besides the common electrode 17***a*; thereby, a uniform voltage can be applied to the individual heating resistors 16.

In this case, in the present embodiment, for the insulation between the conductive layer 13 and the heating resistors 16, the insulating layer 15 composed of $Ta_2O_5/SiO_2$ is used, which is obtained with a thermal oxidation method, so that the inside of a pin hole on the conductive layer 13 is also made to have insulating property, and moreover, the insulating layer 15 is formed to be a unity with the conductive layer 13, which makes it possible to improve the insulating property and the adhesive property of the insulating layer 15 remarkably. Moreover, high temperature annealing of the whole substrate 11 is performed simultaneously with the execution of the thermal oxidation process of the surface of the conductive layer 13 to form the insulating layer 15; thereby, the mechanical and thermal reliability of the multilayer wiring substrate B according to the present invention can be secured.

In the present embodiment, the conductive layer 13 and the insulating layer 15 are formed to be a unity, and since the insulating layer 15 is obtained by a thermal oxidation process of the surface of the conductive layer 13, the level of the surface of the insulating layer 15 and that of the surface of the exposed portion 13*a* of the insulation layer 13 can be almost in the same level, and the heating resistors 16 is formed on the upper surfaces of the above-mentioned layers in a state with a small level difference; thereby, the electrical connection between the heating resistors 16 and the conductive layer 13 can be made certain.

Therefore, in the case of a thermal head according to the present invention, even though the space for the wiring portion of the common electrode 17*a* is narrowed close to a limit for the purpose of obtaining a real edge constitution, owing to the conductive layer 13 which has the same function as that of the common electrode 17*a* and is disposed almost on the whole surface of the substrate 11, a uniform voltage can be applied to each of the individual heating resistors, and nonuniformity in the printing ink density or a trouble caused by insufficient current capacity or the like can be certainly prevented, and a proper real edge constitution can be realized. As described in the above, it is made possible to obtain a proper real edge constitution; thereby, the size of the substrate 11 can be made small, the manufacturing cost of a thermal head can be decreased, a resin ink ribbon can be used which has not been used in a conventional thermal head, and printing quality on a rough paper can be remarkably improved. Further, owing to a real edge thermal head, it is made possible to decrease the loss in the abutting pressure of a heating element against a platen, which makes it possible to save power.

The conductive layer 13 and the heating resistors 16 are insulated with the insulating layer 15 formed by a thermal oxidation process; thereby, the insulation layer 15 and the conductive layer 13 can be formed into a unity and the levels of their surfaces can be made to be almost in the same level, insulating property and adhesive property can be remarkably improved, electrical connection between the heating resisters 16 and the conductive layer 13 can be made certain, and the mechanical and thermal reliability of the multilayer wiring substrate B can be secured owing to the high temperature annealing performed simultaneously with the thermal oxidation process of the conductive layer.

Figure 5:
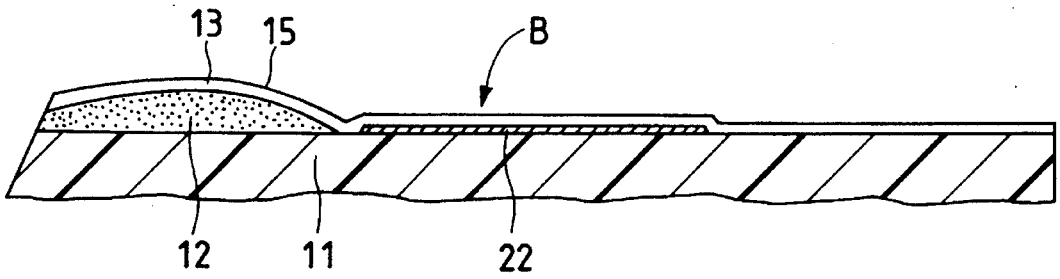
FIG. 5 is a cross sectional view showing another embodiment of a thermal head according to the present invention.

FIG. 5 shows another embodiment of the multilayer wiring substrate B of a thermal head according to the present invention. In the case of a thermal head in the present embodiment, a metallic conductive layer 22 is interpositioned between the substrate 11 and the conductive layer 13 except the heating portion and its neighboring area of the substrate 11, and the multilayer wiring substrate B is constituted to be a double layer constitution composed of the conductive layer 13 and the metallic conductive layer 22.

In the present embodiment, a part of the current which is to flow through the conductive layer 13 is divided to flow through the metallic conductive layer 22, so that the resistance of the conductive layer 13 can be regarded to be lowered.

Figure 6:
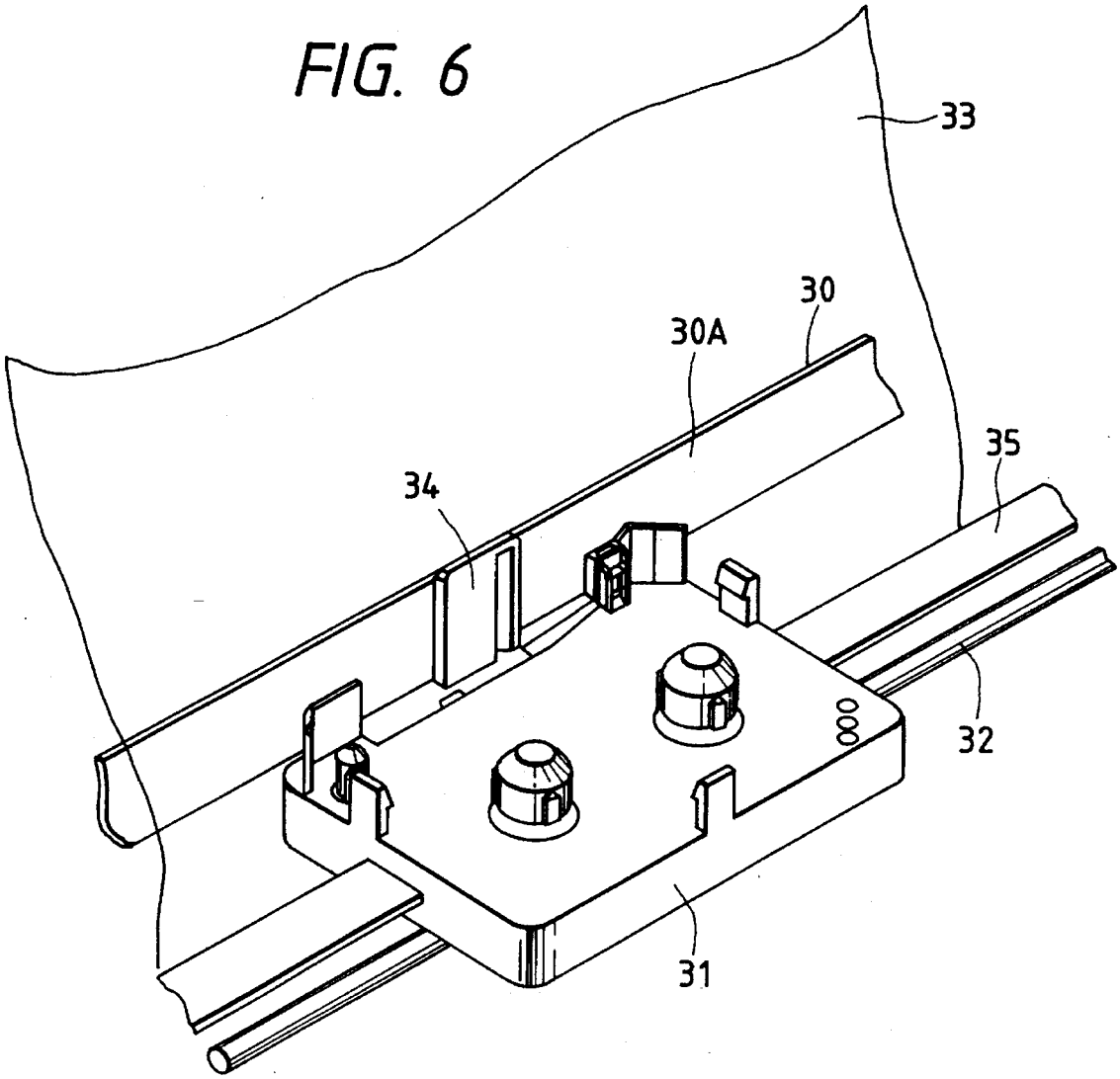
FIG. 6 is a perspective view showing the outline of a thermal printer which uses a thermal head according to the present invention.
Figure 7:
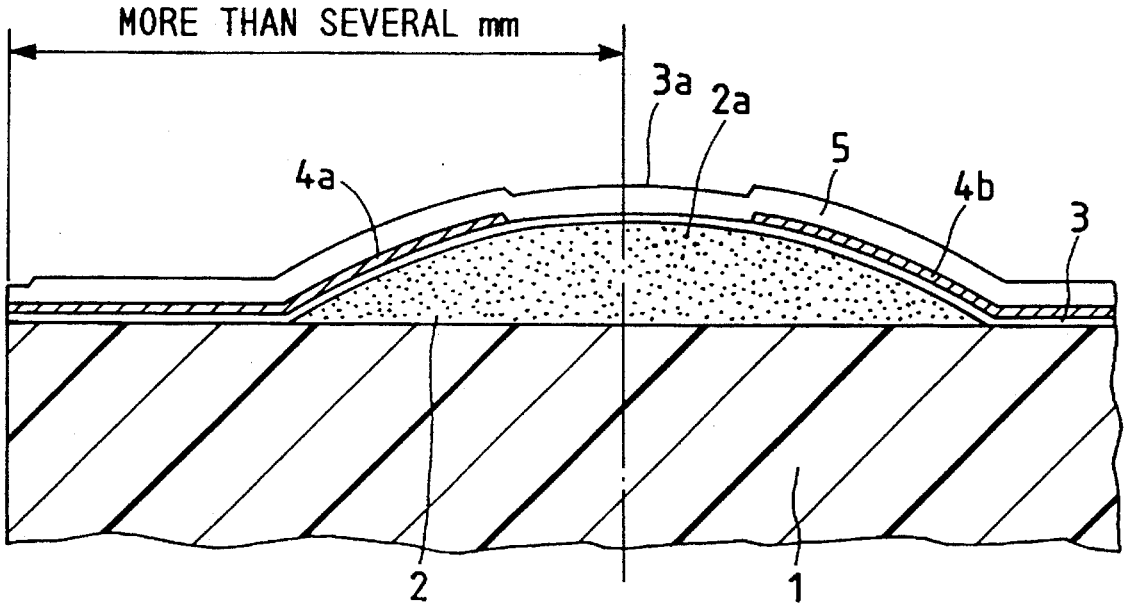
FIG. 7 PRIOR ART
FIG. 7 is a cross sectional view showing a conventional thermal head.

FIG. 6 shows a thermal printer using a thermal head according to the present invention as described in the above. In the figure, a carriage 31 is disposed facing a platen surface 30A of a platen 30 which is formed to be long in horizontal direction and the carriage 31 is arranged to be able to move in the longitudinal direction of the platen 30 along a shaft 32. A thermal head 34 according to the present invention which prints desired characters on a printing paper 33 being pressed against the platen 30 through a printing paper is fixed on the carriage 31 to be able to move freely forward and backward against the platen 30. In a case where printing is performed by thermal transcription system, the thermal head 34 is pressed against the platen through a printing paper 33 and a ink ribbon housed in a ink ribbon cassette (not shown in a drawing) which is mounted on the carriage 31. A reference numeral 35 expresses a timing belt which makes the carriage 31 move along the shaft 32, and it is driven by a motor which is not shown in a drawing.

In the case of the thermal printer, desired printing is performed as shown in the following: while the carriage 31 is moved along the platen 30 in a state where the thermal head 34 is pressed against the platen 30 through a printing paper 33, the heating portion of the thermal head 34 is energized at a desired timing for heating, and the desired printing is performed.

It is possible to prevent the occurrence of nonuniformity in the printing ink density and to realize high quality printing by the use of a thermal printer according to the present embodiment.

The present invention is not limited to the embodiments described in the above, and it can be modified if necessary. For example, it is made possible to form a thermal head omitting the common electrode 17*b* in the present embodiment by the existence of the conductive layer 13.

In the present invention, as described in the above, a conductive layer which has the same function as that of a common electrode is provided almost on the whole surface of a substrate, so that merits as described in the following can be enjoyed: a uniform voltage can be applied to each of the heating resistors, and proper correspondence to the realization of a real edge thermal head is made possible; in the result, nonuniformity in the ink density or a trouble caused by insufficient current capacity can be securely prevented, down sizing of a substrate is made possible, the manufacturing cost can be lowered, the use of an ink ribbon made from a resin group is made possible, printing quality can be remarkably improved, and power saving is made possible in decreasing the loss in the abutting pressure of heating elements against the platen.

The conductive layer and the heating resistors are insulated from each other with an insulation layer formed by thermal oxidation; thereby, following effects can be obtained: the insulation layer and the conductive layer can be formed into a unity, the surface levels of these layers can be made almost in the same level, insulating property and adhesive property can be remarkably improved, electrical connection between the heating resistors and the conductive layer can be made certain, and the mechanical and thermal reliability of the multilayer wiring substrate can be secured by the high temperature annealing performed simultaneously with the execution of a thermal oxidation process of the conductive layer.

I claim:

1. A thermal head comprising:

a heat insulating substrate;

a heating layer formed on the substrate, the heating layer having an arcuate upper surface defining an apex;

a conductive layer formed on said heating layer;

an insulating layer formed on the conductive layer such that a portion of the conductive layer is exposed, the exposed portion being located on a first side of the apex;

a heating resistor layer formed over the insulating layer and the exposed portion of the conductive layer;

a first electrode formed on the heating resistor layer above the exposed portion of the conductive layer; and a second electrode formed on the heating resistor layer and located on a second side of the apex;

wherein the insulating layer comprises an oxide of the conductive layer.

2. The thermal head according to claim 1, further comprising a metallic conductive layer formed on the substrate and located adjacent the heating layer, the conductive layer being formed on the metallic conductive layer.

3. The thermal head according to claim 1, wherein the conductive layer comprises Ta-$SiO_2$ cermet.

4. The thermal head according to claim 1, wherein the conductive layer comprises a silicide resistor material comprising Ta and Si.

5. A thermal printer including:

a platen;

a carriage disposed to reciprocate along the platen; and a thermal head mounted on the carriage;

wherein printing is performed on a sheet by pressing the thermal head against the platen with the sheet located therebetween; and wherein the thermal head comprises:

a heat insulating substrate;

a heating layer formed on the substrate, the heating layer having an arcuate upper surface defining an apex;

a conductive layer formed on said heating layer;

an insulating layer formed on the conductive layer such that a portion of the conductive layer is exposed, the exposed portion being located on a first side of the apex;

a heating resistor layer formed over the insulating layer and the exposed portion of the conductive layer;

a first electrode formed on the heating resistor layer above the exposed portion of the conductive layer; and a second electrode formed on the heating resistor layer and located on a second side of the apex;

wherein the insulating layer comprises an oxide of the conductive layer.

* * * * *